US008936073B1

(12) United States Patent
Phillips

(10) Patent No.: US 8,936,073 B1
(45) Date of Patent: Jan. 20, 2015

(54) DRILLING RIG WITH A STATIC RESISTANT SYNTHETIC INTER-CONNECTABLE STRUCTURAL MAT

(75) Inventor: Mark L. Phillips, Lafayette, LA (US)

(73) Assignee: HB Green Resources, LLC, Lafayette, LA (US)

( * ) Notice: Subject to any disclaimer, the term of this patent is extended or adjusted under 35 U.S.C. 154(b) by 745 days.

(21) Appl. No.: 13/163,191

(22) Filed: Jun. 17, 2011

(51) Int. Cl.
*E21B 19/00* (2006.01)
*E04B 5/02* (2006.01)

(52) U.S. Cl.
USPC ..... 166/75.11; 175/219; 404/35; 52/309.14

(58) Field of Classification Search
USPC ..... 166/75.11, 243; 175/219; 404/35; 52/309.14
See application file for complete search history.

(56) References Cited

U.S. PATENT DOCUMENTS

| | | | | |
|---|---|---|---|---|
| 4,388,484 | A * | 6/1983 | York | 174/5 R |
| 4,462,712 | A * | 7/1984 | Penland, Sr. | 404/36 |
| 6,380,309 | B1 | 4/2002 | Parker et al. | |
| 8,382,393 | B1 * | 2/2013 | Phillips | 404/35 |
| 8,383,732 | B1 * | 2/2013 | Phillips | 525/240 |
| 2010/0243242 | A1 * | 9/2010 | Boney et al. | 166/250.01 |
| 2011/0299923 | A1 * | 12/2011 | Bleile et al. | 404/35 |

* cited by examiner

*Primary Examiner* — Catherine Loikith
(74) *Attorney, Agent, or Firm* — Buskop Law Group, PC; Wendy Buskop

(57) ABSTRACT

A drilling rig with static resistant synthetic inter-connectable structural mat assembly. The assembly has a plurality of static resistant mats, wherein each mat engages another mat without tools or fasteners and each mat has a top layer, a middle layer, a bottom layer, a static charge conduction conduit through the mats, and an optional non-skid coating partially embedded in the mats to support drilling rigs. The mats are made from 100 percent recycled rust proof, non-absorbing post-consumer waste materials.

18 Claims, 4 Drawing Sheets

DRILLING RIG WITH A STATIC RESISTANT SYNTHETIC INTER-CONNECTABLE STRUCTURAL MAT

FIELD

The present embodiments generally relate to a drilling rig with a static resistant synthetic inter-connectable structural mat having a formulation that uses post consumer waste.

BACKGROUND

A need exists for a drilling rig with static resistant synthetic inter-connectable structural mat assembly, wherein the mat has a smaller carbon footprint than mats using new plastics and new rubbers while supporting loads up to 20 tons.

The present embodiments meet these needs.

BRIEF DESCRIPTION OF THE FIGURES

The detailed description will be better understood in conjunction with the accompanying drawings as follows.

Figure 1:
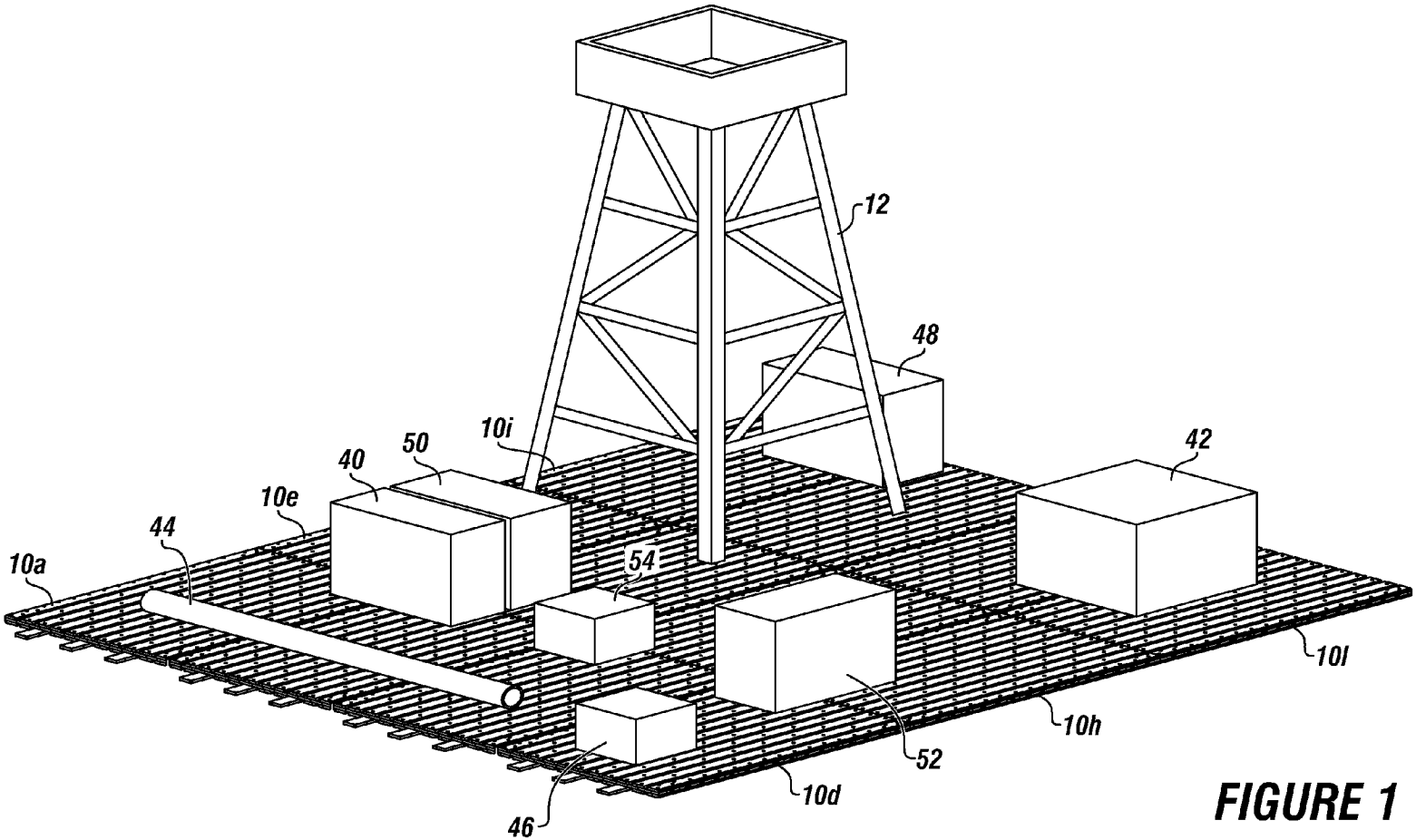
FIG. 1 is a diagram of several modular interconnected mats supporting a drilling rig.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an apparatus of a drilling rig assembly that has interconnected static resistant synthetic inter-connectable structural mats supporting the drilling rig and associated equipment, such as generators, mud tanks, tubulars, tubular handling equipment, pipe racks, top drives, accumulators, motors, water tank, a derrick with hoist, and frac tanks, associated pumps or additional equipment.

Each static resistant mat can be modular for inter-connectability without the need for fasteners or adhesives, and can be formed from three layers of a material, that enables the three-layered mat to withstand at least 1000 pounds of load and up to 20 tons of load without deforming.

Static electricity in one form or another is a phenomenon of nature and often results in electrostatic discharges that can cause fires and explosions.

Improved static resistant mats are needed for the oil and gas drilling industry to reduce static charge buildup on the surface of such mats in association with a derrick, drilling structures of a drilling rig and equipment.

The drilling rig with mat will have less static charge buildup which can improve safety and prevent shocking.

The present embodiments can provide a structural mat that can be used beneath drilling rigs to hold the drilling rig and equipment more securely while simultaneously providing a mat that reduces static charge buildup around the drilling rig.

The mat can be made from recycled materials like recycled detergent bottles, such as TIDE™ bottles to form the structural boards used to make the mats of the drilling rig and mat assembly.

The present embodiments not only addresses the static charge issues for drilling rigs but provides a lower cost drilling rig assembly by providing a factory built structure that can be simply slide into place, rather than a built in place assembly where the rig can then be placed on the mat. Associated equipment with the drilling rig can also be placed on the mat.

The embodiments can include a mat that can be transported without the need for additional road permits by a conventional truck.

The drilling rig uses factory built mats that can be interconnected in the field without the need of screws, or other tools in the field to created an interconnected support structure.

The apparatus can include a structural mat that is designed to allow a unique interlocking of the mats so that no "in field" expertise is required to connect the mats together, and no "in the field" equipment is needed to lock the mats together.

The drilling rig structural mats have a unique surface that can allow static resistant material to protrude in segments of the outer surface to effectively prevent stray electrical currents.

The drilling rig mats can use counter sunk lag screws and bolts that additionally can help improve increase static electricity dissipation to the ground from the top layer of the mat.

The mats can use lag screws which are believed to be conductive at each location, allowing a decentralized and continuous dissipation of electrical charge while preventing mat degradation.

The factory process can allow a significant cost saving on labor as compared with field built mats for drilling rigs.

When the structural mats use structural boards from about 2 inches to about 3 inches in thickness, the three-layered mats can support between 1000 pounds and 20 tons.

Each mat in an embodiment, can have a non-skid coating disposed on at least the top layer and partially embedded in the top layer, to prevent slip and fall accidents. The non-skid material can be sand, silica based material, crumb rubber or a polyamide blended with ethyl vinyl acetate "EVA".

In an embodiment, the non-skid coating can be disposed on at least the top layer in either a continuous or a discontinuous manners.

Additionally the mats can have a non-skid surface on the top layer when at least one groove is formed longitudinally in each board with a depth from about ⅛ of an inch to about 3/16 of an inch and about ½ of an inch wide.

In another embodiment, the mats can have as a non-slip feature, a 30 to 45 degrees bevel formed on each of the boards.

The mats in an embodiment can include a beveling that helps land based rig workers, production crews and similar workers to stay on the rig or site, and not fall and slip on oil or fluids that escape into the surface of the mat, thereby preventing broken bones, preventing concussions, and other lost time accidents which require medical treatment.

By using difficult to degrade materials, such as recycled tire material and detergent bottles, the mats made by this method have a lower fossil fuel foot print.

By using recycled tire material and detergent bottles in the formulation of the mats, the mats can use material that has been removed from the waste stream and otherwise could end up in creeks, on beaches creating trash and litter.

The method reformulates the detergent bottles and tires which are difficult to use and transforms these materials into a usable product that protects the environment from ground water contamination, because the mats are typically disposed over a liner that prevent environmental spills.

The drilling rig with the mat can have a drill floor and surrounding work area that is resistant to corrosive materials and non-absorbing. There are no pores in the mats for absorbing oil or contaminates from a drilling rig floor, so mats can be safely washed off and transported to another site when needed without contaminating adjacent soil.

The mats can have three layers of structural boards. The structural boards can be formed from a blend of about 75 percent by weight to about 92 percent by weight based on the total blend of ground plastic particles. The ground plastic particles can have diameters ranging from about 1/16 of an inch to about 1/4 of an inch.

The ground plastic particles can be blends of high density polyethylene (HDPE) particles blended and with polyethylene terephthalate particles. In another embodiment, the ground plastic particles can be a blend of HDPE and low density polyethylene (LDPE) with polyethylene terephthalate particles.

The blend ratio of polyethylene to polyethylene terephthalate particles can range from 10:1 to 1:10.

To the ground plastic particles, rubber can be added, from about 50 percent to about 80 percent by weight based on the total blend, which can be 100 percent ground styrene-butadiene rubber particles.

The ground styrene-butadiene rubber particles can have a diameter from about 1/16 of an inch to about 1/4 of an inch. The ground styrene-butadiene rubber can come from used tires, which can be cut using a high shear cutting device, such as a continuous feed high speed cutter.

To the blend of ground styrene-butadiene with ground plastic particles, antistatic particles can be added from about 2 percent by weight to about 10 percent by weight based of the total blend, which can be used for preventing static charge buildup in the resultant structural boards. Carbon black can be used for lowering the static charge buildup.

The antistatic particles can have a diameter from about 1/16 of an inch to about 1/4 of an inch.

To the blend of ground styrene-butadiene, ground plastic particles with antistatic particles, an ultraviolet stabilizer material can be added from about 0.5 percent to about 5 percent by weight based on the total blend.

The ultraviolet stabilizer material can have a diameter from about 1/16 of an inch to about 1/4 of an inch. The resultant formulation can be referred to herein as the "total blend."

The total blend can be placed into an extruder, such as a single screw banbury type extruder for heating and mixing using a temperature from about 200 degrees Fahrenheit to about 385 degrees Fahrenheit, or until a homogenous mixture is created as the extrudate.

The extruder heats and mixes until the blend of ground particles are extrudable into a static resistant structural board which has the antistatic material partially protruding through an outer surface of the static resistant structural board.

The antistatic particles can be blended and randomly connected to each other which unexpectedly facilitates dissipation of static charge buildup in the structural boards, creating a density of at least 10 particles per square inch. The extrudate can dissipate voltage when the voltage is from about $10^{-5}$ volts to about $10^{-12}$ volts.

In one or more embodiments, the antistatic particles can be dissipaters that prevent static electrical buildup and maintain a voltage dissipation at or below $10^{-11}$ volts.

While the extrudate may appear to have the shape of structural boards, the important feature is that the extrudate is still warm.

In embodiments, the extrudate can then be coated with a slip resistant coating to ensure integration of the slip resistant material into the top surface rather than simply coating on the top surface. The slip resistant material can be embedded and partially encapsulated in the extrudate while the extrudate is still warm.

The slip resistant material in another embodiment can be blended into the ground particles while in the extruder.

In an embodiment, the slip resistant coating can be deposited at least partially, such as over from about 50 percent to about 75 percent of the surface area of the extrudate.

While the static resistant extrudate cools from about 10 degrees Fahrenheit to about 30 degrees Fahrenheit, the slip resistant material becomes attached to the extrudate without the need for fasteners or adhesives, providing partial encapsulation of the slip resistant material to ensure it stays on the extrudate.

The thickness of the slip resistant material can range from about 1/16 of an inch to about 3/16 of an inch into the extrudate. The slip resistant material can be a polyamide, such as nylon, a low density polyurethane, a ethylene vinyl acetate (EVA), and combinations thereof, can be used as the slip resistant material.

The slip resistant coating can be from about 0.01 percent by weight to about 6 percent by weight of the total weight of the static resistant structural board.

In an embodiment, the drilling rig and mat assembly can use mats that can be created by first forming a layer of structural boards, termed "bottom boards" in a "jig" which can also be termed herein as a "fixture".

The bottom boards can have a length which enables the resultant mat to be transported by truck over a roadway without the need to special permits.

The bottom boards can have a length from 4 feet to 12 feet to be usable herein. The bottom boards can be parallel to each other. In an embodiment the bottom boards can be spaced apart from about 1/4 of an inch to about 1/2 of an inch.

At least 3 and up to 5 of the bottom boards can be positioned to extend beyond a perimeter of the jig or fixture, to create 3 spaces to 5 spaces in the bottom boards for engagement with a fork lift or another mat.

In embodiments, at least 3 bottom boards and up to 5 bottom boards can be positioned to extend beyond a perimeter of the jig or fixture, to create at least 3 spaces and up to 5 spaces in the bottom boards for engagement with a fork lift or with another mat.

The bottom boards can be positioned in a first direction termed herein "a first orientation".

Positioned over these bottom boards can be middle boards, which can have the same formulation and can be formed in the same manner as the bottom boards.

The middle boards can be positioned in a second orientation, such as at about a 90 degree angle from the first orientation of the bottom boards.

In another embodiment, the second orientation can be on a bias, such as an angle from about 30 degrees to about 50 degrees.

The middle boards can be positioned in parallel to each other and spaced in a similar spacing as the bottom boards, which can range from about 1/2 of an inch to about 1/8 of an inch.

The middle boards do not cover the extending portion of the extending bottom boards.

Top boards can be positioned over the middle boards. Top boards can be made of the same formulation as the bottom and middle boards. The top boards can be positioned in the first orientation parallel with the bottom boards.

In an embodiment, the top boards can be positioned parallel to each other and spaced apart from a flush engagement, where the boards are touching to about 1 inch apart.

The top boards can cover all the middle boards and do not cover the extending portion of the extending bottom boards.

In another embodiment, the top boards can be positioned identically to the bottom boards, when a lip is secured to the extended portions of the top and bottom boards, forming an interlock or lip lock.

A mat perimeter can be formed when the three layers of structural boards are positioned over each other.

Extended portions of the bottom layer can extend at the same length beyond the perimeter. In another embodiment, both the extended portions of the top layer and the bottom layer can extend beyond the perimeter, but on opposite ends of the overall mat for the drilling rig.

The mat can be assembled by first drilling holes through the top boards, the middle boards and partially into the bottom boards. Next, lag screws can be installed in the holes, termed "pilot holes" to secure the three layers of structural boards together.

In embodiments, from about 10 lag screws and bolts to about 20 lag screws and bolts can be used per board. The lag screws and bolts can be used to totally penetrate the top structural boards, the middle structural boards and to partially extend into the bottom structural boards, thereby providing a static charge conduit through the formed mat from the top surface of the mat to a ground, which prevents static buildup on the drilling rig.

The layered structure with antistatic material protruding through the surface of the structural boards, the plurality of openings and extensions provides an antistatic mat for supporting loads that is easy to lift, while supplying a secure interlock with other boards without the need for additional tools or materials, and the lag screws extending from the top structural boards, the middle structural boards and partially into the bottom structural boards form a static resistant synthetic inter-connectable structural mat.

The formed mats, whether interlocked or not, can support vehicles, heavy equipment, the derrick of the drilling rig while simultaneously providing resistance to corrosive materials, and having the ability to be transported using conventional trucks on conventional roadways without a permit.

In an embodiment, the drilling rig uses mats that have boards that can be about 4 feet to 12 feet long, about 7 inches to 9 inches wide, and about 1.5 inches to about 2 inches thick.

In an embodiment, the mats can have a slip resistant coating that can be deposited in discontinuous portions on the outer surface of the static resistant structural member.

In an embodiment, the slip resistant material can be a silica based material, such as sand, or a crumb rubber, a polyamide and ethyl vinyl acetate blend provided that none of these material have a particulate with a diameter larger than about ⅛ of an inch and can be as small as about 1/16 of an inch, and can be about ¼ of an inch diameter. Combinations of these materials can be used to create the mats. In an embodiment, the polyamide and ethyl vinyl acetate blend can be in a 1:1 ratio In an embodiment, from about 9 structural boards to about 12 structural boards can be used in the bottom layer. The bottom layer members can be positioned in a fixture in a first orientation, termed herein a "longitudinal" orientation, and the bottom layer can create a perimeter.

Three alternating board members of the bottom layer members can be positioned to extend at from about 12 inches from the bottom perimeter to provide a male mating portion for this first bottom layer with a female mating portion of a bottom layer of another mat. This male/female mating can allow for engagement in the field of the mats without using tools or special training.

In the fixture, middle structural boards can be positioned in a second orientation.

In this embodiment, the middle layer can use from about 15 parallel static resistance structural boards to about 20 parallel static resistance structural boards, wherein each middle structural member can be about 7 feet to about 9 feet long. This length can allow the mats to be transported by truck to a drilling rig.

The middle layer in this embodiment can have the structural board members oriented at about a 90 degree orientation to the bottom layer first orientation. A top layer of the structural board members can be positioned over the middle layers, again in the first orientation in the fixture.

The top layer can use from about 9 parallel static resistance structural members to about 13 parallel static resistance structural members. These members can be spaced apart from a flush engagement, touching each other, to an separation of about ½ of an inch apart. In an embodiment, the board members in the top layer can be flush against each other with no gap between the boards.

To attach the layers together and form the mat, pilot holes can be used in the top layer, the middle layer and partially through the bottom layer. The diameter of the pilot holes can range from about ⅛ of an inch to about ¾ of an inch.

The lag screws can be positioned through the pilot holes. The lag screws can be counter sunk in each pilot hole to a depth from about 1/16 of an inch to about 3/16 of an inch. Once the lag screws are sunk into the pilot holes, the formed three-layered mat with extensions and openings can then be removed from the fixture and usable with the drilling rig.

In embodiments, the mat can be positioned under the drilling rig derrick directly. In embodiments, the mat can be positioned adjacent the drilling rig derrick to support mud pumps, pipe handling equipment, tubulars, casing, mixing tanks, and similar equipment found on a drilling rig, including rough neck tools.

In an embodiment, a mat can be formed having a bottom layer of about 11 boards to about 12 boards with at least a ½ inch gap between boards, which can be usable with the drilling rig.

In an embodiment, the top layer can provide gaps between the structural boards which are only large enough to allow water to flow from the top surface, preventing water build up around the temporary roadway while allowing workers to safely stand on the mats and additional tools to be supported on the mats without the tools falling through the cracks becoming non-retrievable.

In another embodiment, the bottom layer can have from about 9 structural members to about 12 structural members, wherein the structural members can all be parallel, and can also include a fixture. Each of the structural members can be a static resistant structural member from about 9 feet to about 12 feet in length.

In an embodiment, each of the structural members of this embodiment can be a partially slip resistant coated static resistant structural member.

The structural members can be positioned in the fixture at a first orientation or a "longitudinal" orientation and the bottom layer can create a bottom perimeter.

A middle layer of structural members can then be positioned in a second orientation in the fixture, overlaying the bottom layer.

The middle layer can use from about 15 structural board members to about 20 structural board members, wherein each structural board member can be parallel to the other, and each static resistance structural members can be from about 6 feet to about 8 feet in length.

A top layer can use from about 9 structural board members to about 13 structural board members, which can be parallel to each other and can be placed over the middle layer. In each layer the structural board members can be static resistant structural members as described above, in which the formulation can contain from about 10 percent to about 50 percent by weight of ground plastic particles and from about 50 percent to about 80 percent by weight of ground styrene-butadiene rubber particles.

In this version, an upper L-shaped lip can be formed at one longitudinal end of the bottom layer and a lower opposing L-shaped lip can be formed at the opposite longitudinal end of the top layer.

These lips can be formed by attaching to extended structural members from the perimeter, a lip edge particularly, attaching an upper L-shaped lip to extend downwardly, and a lower L-shaped lip to extend upwardly allowing the lower L-shaped lip to engage the upper L shaped lip of an adjacent mat, forming a lip lock.

The extended portions can be alternating structural boards. All the extended portions can extend at the same distance forming corresponding opening in the opposite ends. Onto these extended portions, a lip edge can be created.

The Figures depict the lip embodiment of the mat in more detail. In general, both the bottom and top layers can be oriented to have the extended portions as previously described for just the bottom layer.

In another embodiment, the assembly can use from about 0.01 percent to about 3 percent by weight of the total weight, of a non-caustic soda with the ground plastic particles to prevent curling of the boards.

This non-caustic soda can be baking soda, and can be used to prevent curling of the boards in temperatures below 45 degrees Fahrenheit.

As described in prior embodiments, the extended portions can be alternating boards. All the extended portions can extend at the same distance forming corresponding opening in the opposite ends. To these extended portions, a lip edge can be created.

The top layers can have a downwardly extending lip edge on an opposite side of the mat as the bottom layers can have an upwardly extending lip edge allowing an upper L-shaped lip of a first mat to engage a lower L-shaped lip of a second mat allowing the mats to connect without the use of tools or other fasteners.

The mats created by this embodiment allow a plurality of these mats to be arranged in sequence adjacent to one another by placing the upper L-shaped lip of succeeding mats over the lower L-shaped lip of the preceding adjacent mat so as to lock the mats together.

Turning now to the Figures, FIG. 1 is a diagram of a drilling rig with mat assembly, shown with a plurality of interconnected modular mats 10*a*-10*l* depicted beneath a drilling rig 12.

The drilling rig 12 can have additional equipment, which can also be supported by the mats, shown here as generators 40, mud tanks 42, tubulars 44, tubular handling equipment 46, pipe racks 48, motors 50, and frac tanks 52, as well as associated pumps 54.

Figure 2:
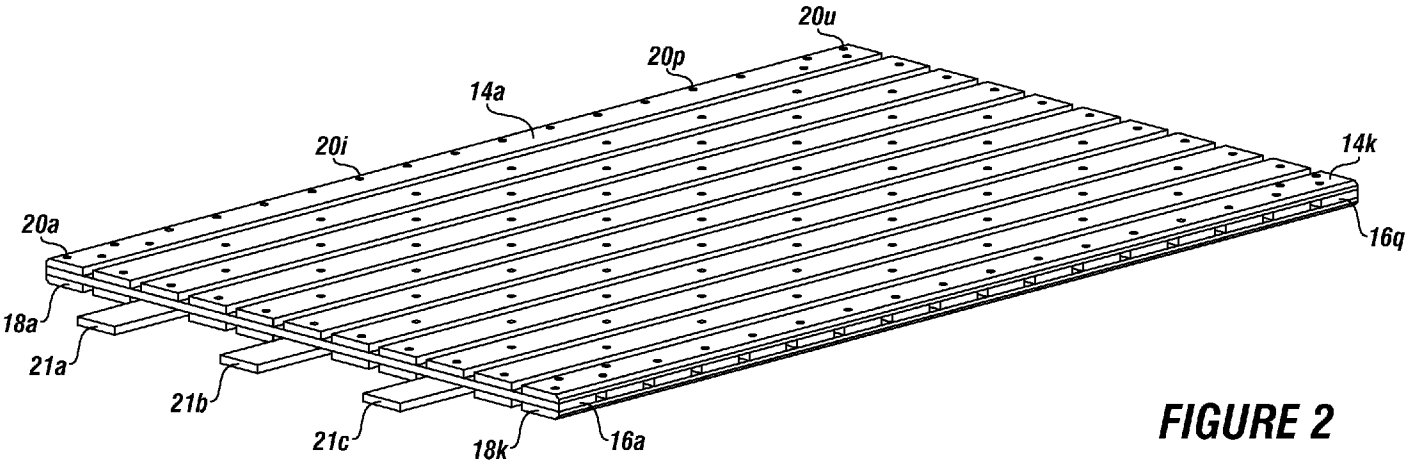
FIG. 2 is a top perspective view of an assembled three-layered mat with the extending portions.

FIG. 2 a top perspective view of an assembled three-layered mat with the extending portions.

The mats are each constructed forming a top layer from a plurality of top layer structural boards 14*a*-14*k*, forming a middle layer from a plurality of middle layer structural boards 16*a*-16*q*, and forming a bottom layer from a plurality of bottom layer structural boards 18*a*-18*k*. In this Figure, the top layer is shown connected to the middle layer and bottom layer with a plurality of lag screws and bolts 20*a*-20*u*.

The structural boards can be made from an extruded blend of ground particles which can include: (i) 50 percent by weight to 30 percent by weight based on the total blend of ground plastic particles of high density polyethylene particles, and polyethylene terephthalate particles, or combinations thereof; (ii) 50 percent by weight to 80 percent by weight based on the total blend of rubber, which can be 100 percent ground styrene-butadiene rubber particles; (iii) from 2 percent by weight to 10 percent by weight based on the total blend of antistatic particles for preventing static charge buildup; (iv) 0.5 percent by weight to 5 percent by weight based on the total blend of an ultraviolet stabilizer material, then placing the blend of ground particles into an extruder for heating and mixing using a temperature from about 200 degrees Fahrenheit to about 385 degrees Fahrenheit until the blend of ground particles are extrudable into a static resistant structural board; wherein the antistatic material partially protrudes through an outer surface of the static resistant structural board; coating the static resistant structural board while the board is at a temperature from about 200 degrees Fahrenheit to about 385 degrees Fahrenheit with a slip resistant material forming the partially slip resistant coated static resistant structural board. The slip resistant material can be carbon fibers.

The slip resistant coating can be from about 0.01 percent by weight to about 6 percent by weight of the total weight of the partially slip resistant coated static resistant structural board. After integrating the coating into the material of the board, such as by partial encapsulation, the board can then be cooled to form the partially slip resistant coated static resistant structural boards usable with the temporary roadway.

In an embodiment, only these ingredients can be used in the formulation to provide maximum strength, load support to about 5000 pounds when the formulation is less than about 2 inches thick, and resistance to toxic substances, such as oil, and essentially zero porosity to resist collection of water or other toxic materials at a drill site.

In embodiments, the antistatic material can be blended in the formulation and create various random particle connections with other antistatic particles to facilitate dissipation of static charge buildup in the structural boards, and creating a density of at least 10 particles per square inch.

In this Figure, the extended portions 21*a*, 21*b*, and 21*c* of three of the bottom layer boards are depicted. By extending these boards a preset amount, corresponding holes can be formed in the opposite end of the formed mat.

Figure 3:
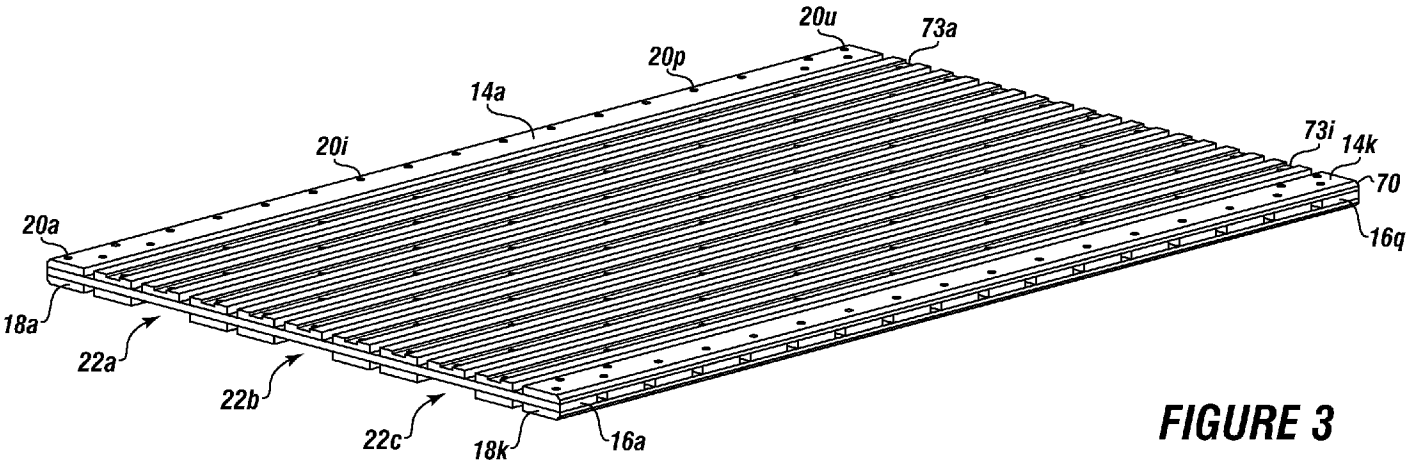
FIG. 3 is a detailed perspective view of an assembled three-layered mat with extending portions and slip resistant features.

FIG. 3 is a top perspective view of an assembled three-layered mat with the extending portions and slip resistant features.

The mats are each constructed by forming a top layer from a plurality of top layer structural boards 14*a*-14*k*, forming a middle layer from a plurality of middle layer structural boards 16*a*-16*q*, and forming a bottom layer from a plurality of bottom layer structural boards 18*a*-18*k*. In this Figure, the top layer is shown connected to the middle layer and bottom layer with a plurality of lag screws and bolts 20*a*-20*u*.

The structural boards can be made from an extruded blend of ground particles which can include: (i) 90 percent by weight based on the total blend of ground plastic particles of high density polyethylene particles, and polyethylene terephthalate particles, or combinations thereof; (ii) 2 percent by weight based on the total blend of rubber which can be 100 percent ground styrene-butadiene rubber particles; (iii) 2 percent by weight based on the total blend of antistatic particles for preventing static charge buildup; (iv) 5 percent by weight based on the total blend of an ultraviolet stabilizer material, then placing the blend of ground particles into an extruder for heating and mixing using a temperature from about 200 degrees Fahrenheit to about and 385 degrees Fahrenheit until the blend of ground particles are extrudable into a static resistant structural board. The antistatic material partially protrudes through an outer surface of the static resistant structural board; coating the static resistant structural board while the board is at a temperature from about 200 degrees Fahrenheit to about and 385 degrees Fahrenheit. Additionally, 1 percent by weight of a slip resistant material can be pushed into the extrudate.

In an embodiment, the slip resistant grooves 73*a*-73*i* can be formed in the extrudate as seen in FIG. 3. A beveled edge 76 can also be formed on the boards for slip resistance.

The extended portions 21*a*, 21*b*, and 21*c* of three of the plurality of bottom layer structural boards, which are shown in FIG. 2 form corresponding holes 22*a*, 22*b*, and 22*c* in the opposite end of the formed mat, which are shown in this Figure.

Figure 4A:
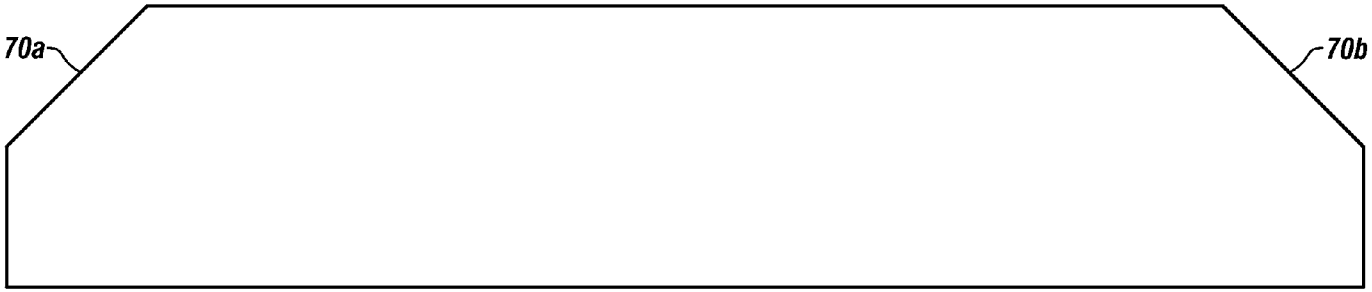
FIGS. 4A-4B are front views depicting two different embodiments of a top structural board shape.

FIG. 4A shows a front view of an embodiment shape of a top layer board, having beveled edges 70*a* and 70*b*. The bevel edge can be about ½ an inch of the side of the board allowing water to easily run off.

Figure 4B:
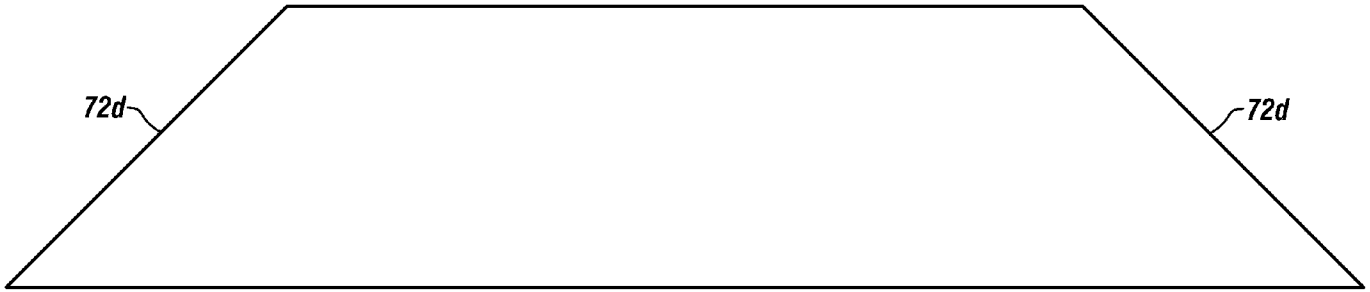

FIG. 4B is a front view of an embodiment shape of a top layer board having taper edges 72*a* and 72*b* extending the entire length of the board, for situations when more water needs to be removed from the top layer. An embodiment of this version can have a board about 1.5 inches in height with the taper edge using 1.5 inches to slope from one surface to another of the board.

Figure 5:
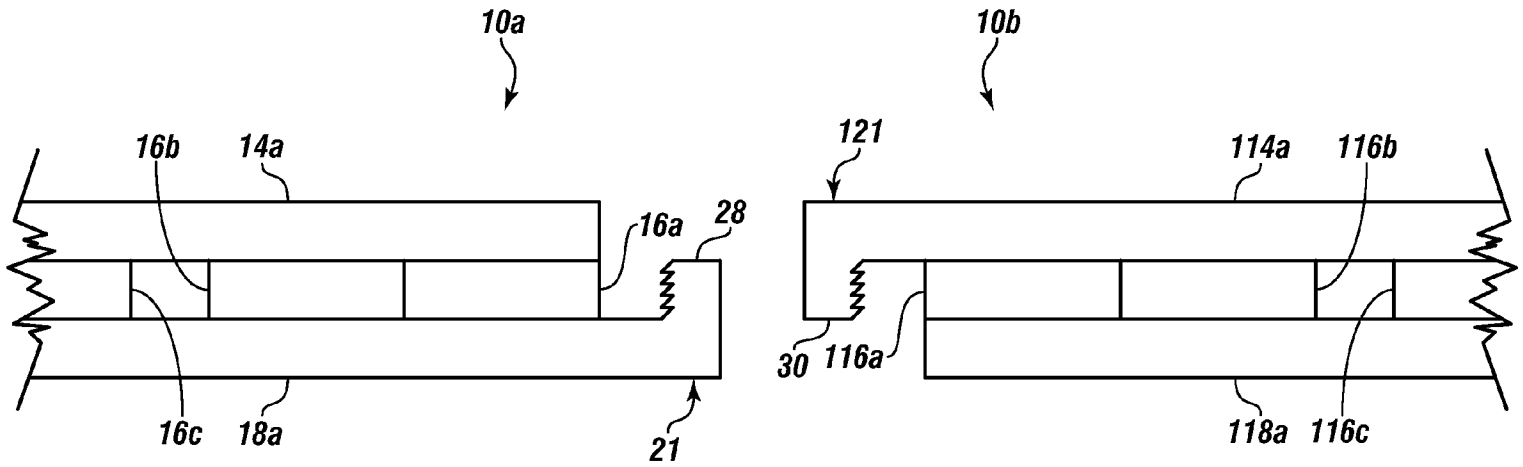
FIG. 5 is a side view of two inter-connectable mats usable under the drilling rig with L-shaped lips locking the mats together.

FIG. 5 shows the bottom layer structural board 18*a* of a first mat 10*a* depicted with a bottom layer extended portion 21 having a bottom lip 28 that extends toward the top layer structural board 114*a* of an adjacent or second mat 10*b*.

The first mat 10*a* is shown in this Figure with a top layer structural board 14*a*, middle layer structural boards 16*a*, 16*b* and 16*c* and a bottom layer structural board 18*a*.

The second mat 10*b* is shown in this figure with a top layer structural board 114*a*, middle layer structural boards 116*a*, 116*b* and 116*c* and a bottom layer structural board 118*a*.

Each bottom lip can be the width of a bottom layer structural board, and have a length from about 3 inches to about 14 inches, and a height from the bottom layer structural board from about 1 inches to about 7 inches.

The top layer structural board 114*a* of an adjacent or second mat 10*b* is shown having top extended portion 121 having a top lip 30, which can have a different size than the bottom lip. In another embodiment, the top lip can have the same size and characteristics as the bottom lip. The top lip 30 can be mounted in a downward positioning facing the bottom layer structural board 18*a*.

The top lip and the bottom lip in an embodiment can be installed on the top and bottom boards while the boards are still warm, and then additionally held in place with lag screws and bolts, allowing the lip to have a seamless integration into the boards.

Examples of various specific formulations of the structural boards follow:

Example 1

The ground blend consists of 91 percent by weight based on the total blend of ground plastic particles, of which 40 percent is high density polyethylene particles and 60 percent is polyethylene terephthalate particles; (ii) 3 percent by weight based on the total blend of ground styrene-butadiene rubber particles; (iii) 2 percent by weight based on the total blend of an antistatic particles for preventing static charge buildup, wherein the antistatic particles have a diameter from about ⅛ of an inch to about ¼ of an inch to allow for partial protrusion through a formed outer surface and randomized particle connections with each other to facilitate dissipation of static charge buildup in the structural boards, and creating a density of at least 10 particles per square inch.

To the plastic particles are also added 3 percent by weight based on the total blend of an ultraviolet stabilizer material; and 1 percent by weight based on the total weight of the blend of a slip resistant coating.

Example 2

The ground blend consists of 91 percent by weight based on the total blend of ground plastic particles which are 60 percent high density polyethylene particles; and 40 percent polyethylene terephthalate particles; 2 percent by weight based on the total blend of ground styrene-butadiene rubber particles; 4 percent by weight based on the total blend of antistatic particles for preventing static charge buildup, wherein the antistatic particles have a diameter from about ⅛ of an inch to about ¼ of an inch to allow for partial protrusion through a formed outer surface.

It can be noted that the antistatic particles are blended during mixing creating randomized particle connections with each other to facilitate dissipation of static charge buildup in the structural boards, and creating a density of at least 10 particles per square inch.

In this example, there is also added to the plastic particles 1.5 percent by weight based on the total blend of an ultraviolet stabilizer material; and 1.5 percent by weight based on the total weight of the blend of a slip resistant material, such as nylon or EVA or combinations thereof.

Example 3

The ground blend consists of 79.5 percent by weight based on the total blend of ground plastic particles having 10 percent high density polyethylene particles; and 90 percent polyethylene terephthalate particles; (ii) 3.5 percent by weight based on the total blend of ground styrene-butadiene rubber particles; (iii) 10 percent by weight based on the total blend of an antistatic particles for preventing static charge buildup, wherein the antistatic particles have a diameter from about ⅛ of an inch to about ¼ of an inch to allow for partial protrusion through a formed outer surface and randomized particle connections with each other to facilitate dissipation of static charge buildup in the structural boards, and creating a density of at least 10 particles per square inch.

To the plastic particles is also added 4 percent by weight based on the total blend of an ultraviolet stabilizer material; and 3 percent by weight based on the total weight of the blend of a nylon slip resistant material.

To all of these examples, can be added from 0.01 percent by weight to 3.0 percent by weight of the total weight, of a non-caustic soda with the ground plastic particles to prevent curling. The non-caustic soda can be baking soda. The non-caustic soda prevents curling from temperature variations from the temperatures of materials on the mat to the outside temperatures.

In another embodiment it can be noted that using 4 and ½ inch lag screws provide a highly conductive conduit in forming the mats.

In another embodiment, the method can include the step of colorizing the boards based on content of plastic or crumb rubber in the boards, to distinguish arctic boards from temperate climate boards, to distinguish between boards that support loads of 1 ton to loads of 5 tons.

Example 4

A black structural board might use 1000 pounds of colored high density polyethylene which is post consumer, with 35 pounds of shredded recycled rubber plus ¼ pounds of sodium bicarbonate (to prevent curling) with 1 pound of black colorant plus ultraviolet (UV) stabilizer plus antistatic material.

Example 5

A black structural board might use 1000 pounds of colored high density polyethylene which is post consumer, with 35 pounds of shredded recycled rubber plus ¼ pounds of sodium bicarbonate (to prevent curling) with 1 pound of black colorant plus antistatic material.

Example 6

A green structural board might use 1000 pounds of colored high density polyethylene which is post consumer, with 35 pounds of shredded recycled rubber plus ¼ pounds of sodium bicarbonate (to prevent curling) with 2 pounds of green colorant plus UV stabilizer, plus antistatic material.

Example 7

In this example, ground plastic particles made of 15 percent by weight high density polyethylene is used with 72 percent by weight low density polyethylene and 5 percent by weight polyethylene terephthalate. 2 percent by weight of ground rubber particulates can then be added which solely consist of post consumer shredded tires of styrene-butadiene rubber.

To these components are added ½ percent by weight baking soda, and 5 percent by weight slip resistant material made up of 2.5 percent by weight polyamide (a nylon 6), with 2 and ½ percent by weight ethyl vinyl acetate and ½ percent by weight of an antistatic material consisting essentially of carbon black.

While these embodiments have been described with emphasis on the embodiments, it should be understood that within the scope of the appended claims, the embodiments might be practiced other than as specifically described herein.

What is claimed is:

1. A drilling rig with a static resistant synthetic inter-connectable structural mat assembly, wherein the mat can: support vehicles, support heavy equipment, dissipate static charge, resist corrosive materials, and be transported using conventional trucks on conventional roadways without a special permit, wherein the drilling rig and mat assembly comprises:

a. a drilling rig with derrick with hoist; water tank, mud pump, mud tank, frac tank, motors, other pumps, generators, tubing handling equipment;

b. a plurality of static resistant mats interconnected beneath the drilling rig, wherein each mat comprises:

i. a bottom layer of a first plurality of static resistant structural boards, wherein the static resistant structural boards are parallel to each other, wherein the plurality of static resistant structural boards are spaced apart from one another by from ¼ of an inch to ¾ of an inch, wherein the plurality of static resistant structural boards are oriented in a first longitudinal orientation, with alternating bottom static resistant structural boards extending beyond an adjacent bottom static resistant structural board as an extended portion while forming corresponding openings between adjacent bottom static resistant structural boards opposite the extended portions;

ii. a middle layer of a second plurality of static resistant structural boards, wherein static resistant structural boards of the second plurality of static resistant structural boards are parallel to one another, and wherein the static resistant structural boards of the second plurality of static resistant structural boards are spaced apart from one another by from ¼ of an inch to ¾ of an inch, wherein the second plurality of static resistant structural boards are in a second longitudinal orientation over the bottom layer, wherein the second orientation is at a 90 degree angle to the first orientation; and iii. a top layer of a third plurality of structural boards, wherein the structural boards of the third plurality of structural boards are parallel to one another, and wherein the structural boards of the third plurality of structural boards are flush with one another or spaced apart from one another by up to ¾ of an inch, and wherein the third plurality of structural boards are oriented in the first longitudinal orientation over the middle structural boards;

c. a plurality of lag screws disposed through the top layer, the middle layer and the bottom layer, providing a static charge conduit from the top layer to a ground; wherein each static resistant structural board of the top layer, the middle layer and bottom layers comprises:

i. from 50 percent by weight to 92 percent by weight based on the total blend of ground plastic particles, further comprising:

1. polyethylene particles or blends of high density polyethylene with low density polyethylene; and 2. polyethylene terephthalate particles, in a ratio from 1:10 to 10:1;

ii. from 0.5 percent by weight to 3.9 percent by weight based on the total blend of ground styrene-butadiene rubber particles;

iii. from 2 percent by weight to 10 percent by weight based on the total blend of a antistatic particles for preventing static charge buildup, wherein the antistatic particles have a diameter from 1/16 of an inch to ¼ of an inch to allow for partial protrusion through a formed outer surface and randomized particle connections to facilitate dissipation of static charge build up in the structural boards, and creating a density of at least 10 particles per square inch;

iv. from 0.5 percent by weight to 5 percent by weight based on the total blend of an ultraviolet stabilizer material; and v. from 0.01 percent by weight to 3 percent by weight based on the total blend of a non-caustic soda with the ground plastic particles to prevent curling at temperatures less than 45 degrees Fahrenheit.

2. The drilling rig with a static resistant synthetic interconnectable structural mat of claim 1, wherein each of the top layer and bottom layer structural boards are from 4 to 12 feet long, 7 inches to 9 inches wide, and 1.5 to 2 inch thick.

3. The drilling rig with a static resistant synthetic interconnectable structural mat of claim 1, wherein the antistatic particles dissipate static electrical buildup around the rig and maintain a voltage dissipation at or below $10^{-11}$ volts.

4. The drilling rig with a static resistant synthetic interconnectable structural mat of claim 1, further comprising a slip resistant coating applied in at least discontinuous portions on the outer surface of each static resistant structural board member.

5. The drilling rig with a static resistant synthetic interconnectable structural mat of claim 4, wherein the slip resistant coating is a member of the group consisting of: a silica based material, a crumb rubber, a polyamide and ethyl vinyl acetate blend in a 1:1 ratio; and combinations thereof.

6. The drilling rig with a static resistant synthetic interconnectable structural mat of claim 1, further comprising forming a groove longitudinally in each structural board with a depth from ⅛ of an inch to 3⁄16 of an inch and ½ of an inch wide.

7. The drilling rig with a static resistant synthetic interconnectable structural mat of claim 1, further comprising a 30 to 45 degree bevel on each of the boards as a non-slip feature.

8. The drilling rig with a static resistant synthetic interconnectable structural mat of claim 1, wherein the ground plastic particle diameters, the ground rubber particle diameters, the ultraviolet stabilizer particle diameters and the antistatic material diameters range from 1⁄16 of an inch to ¼ of an inch.

9. The drilling rig with a static resistant synthetic interconnectable structural mat of claim of claim 1, further comprising a slip resistant material partially embedded in the static resistant structural board and wherein the thickness of the slip resistant coating ranges from 1⁄16 of an inch to 3⁄16 of an inch, and the slip resistant coating comprises from 0.01 percent by weight to 6 percent by weight of the total weight of the partially slip resistant coated static resistant structural board.

10. A drilling rig with a static resistant synthetic interconnectable structural mat assembly, wherein the mat can support vehicles, support heavy equipment, dissipate static charge, resist corrosive materials, and be transported using conventional trucks on conventional roadways without a special permit, wherein the drilling rig and mat assembly comprises:

a. a drilling rig with derrick with hoist; water tank, mud pump, mud tank, frac tank, motors, other pumps, generators, tubing handling equipment;

b. a plurality of static resistant mats interconnected beneath the drilling rig, wherein each mat comprises:

i. a bottom layer of a first plurality of static resistant structural boards, wherein the static resistant structural boards are parallel to each other, wherein the plurality of static resistant structural boards are spaced apart from one another by from ¼ of an inch to ¾ of an inch, wherein the plurality of static resistant structural boards are oriented in a first longitudinal orientation, with alternating bottom static resistant structural boards extending beyond an adjacent bottom static resistant structural board as an extended portion while forming corresponding openings between adjacent bottom static resistant structural boards opposite the extended portions;

ii. a middle layer of a second plurality of static resistant structural boards, wherein static resistant structural boards of the second plurality of static resistant structural boards are parallel to one another, and wherein the static resistant structural boards of the second plurality of static resistant structural boards are spaced apart from one another by from ¼ of an inch to ¾ of an inch, wherein the second plurality of static resistant structural boards are in a second longitudinal orientation over the bottom layer, wherein the second orientation is at a 90 degree angle to the first orientation;

iii. a top layer of a third plurality of structural boards, wherein the structural boards of the third plurality of structural boards are parallel to one another, and wherein the structural boards of the third plurality of structural boards are flush with one another or spaced apart from one another by up to ¾ of an inch, and wherein the third plurality of structural boards are oriented in the first longitudinal orientation over the middle structural boards; and iv. an upper L-shaped lip formed at each longitudinal end of each extended portion of each top structural board the top layer and a lower opposing L-shaped lip formed at each longitudinal end of each extended portion of each bottom structural board opposite the upper L-shaped lip, and wherein the upper L-shaped lips have a downwardly extending lip edge, the lower L-shaped lips having an upwardly extending lip edge allowing an upper L-shaped lip of a first mat to engage a lower L-shaped lip of a second mat allowing the mats to connect without the use of tools or other fasteners; and c. a plurality of lag screws disposed through the top layer, the middle layer and the bottom layer, providing a static charge conduit from the top layer to a ground; wherein each static resistant structural board of the top layer, the middle layer and bottom layers comprises:

i. from 50 percent by weight to 92 percent by weight based on the total blend of ground plastic particles, further comprising:

1. polyethylene particles or blends of high density polyethylene with low density polyethylene; and 2. polyethylene terephthalate particles, in a ratio from 1:10 to 10:1;

ii. from 0.5 percent by weight to 3.9 percent by weight based on the total blend of ground styrene-butadiene rubber particles;

iii. from 2 percent by weight to 10 percent by weight based on the total blend of a antistatic particles for preventing static charge buildup, wherein the antistatic particles have a diameter from 1⁄16 of an inch to ¼ of an inch to allow for partial protrusion through a formed outer surface and randomized particle connections to facilitate dissipation of static charge build up in the structural boards, and creating a density of at least 10 particles per square inch;

iv. from 0.5 percent by weight to 5 percent by weight based on the total blend of an ultraviolet stabilizer material; and v. from 0.01 percent by weight to 3 percent by weight based on the total blend of a non-caustic soda with the ground plastic particles to prevent curling at temperatures less than 45 degrees Fahrenheit.

11. The drilling rig with a static resistant synthetic interconnectable structural mat assembly of claim 10, further comprising a plurality of grooves in the bottom lip to facilitate engagement with the top lip.

12. The drilling rig with a static resistant synthetic interconnectable structural mat of claim 10, wherein the lips are integral as a one piece structure with the structural boards.

13. The drilling rig with a static resistant synthetic interconnectable structural mat of claim 10, further wherein the antistatic particles dissipate static electrical buildup around the rig and maintain a voltage dissipation at or below $10^{-11}$ volts.

14. The drilling rig with a static resistant synthetic interconnectable structural mat of claim 10, wherein a slip resistant coating is applied in at least discontinuous portions on the outer surface of each static resistant structural board member.

15. The drilling rig with a static resistant synthetic interconnectable structural mat of claim 14, wherein the slip resistant coating is a member of the group consisting of: a silica based material, a crumb rubber, a polyamide and ethyl vinyl acetate blend in a 1:1 ratio; and combinations thereof.

16. The drilling rig with a static resistant synthetic interconnectable structural mat of claim 10, further comprising a groove longitudinally in each board with a depth from 1/8 of an inch to 3/16 of an inch and 1/2 of an inch wide.

17. The drilling rig with a static resistant synthetic interconnectable structural mat of claim 10, further comprising a 30 to 45 degree bevel on each of the boards as a non-slip feature.

18. The drilling rig with a static resistant synthetic interconnectable structural mat of claim 10, wherein the ground plastic particle diameters, the ground rubber particle diameters, the ultraviolet stabilizer particle diameters and the antistatic material diameters range from 1/16 of an inch to 1/4 of an inch.

* * * * *